US008052015B2

(12) United States Patent
Huang

(10) Patent No.: US 8,052,015 B2
(45) Date of Patent: Nov. 8, 2011

(54) HOLDER APPARATUS ADAPTED FOR GRIPPING AND OPERATING A SPRAYER

(75) Inventor: Chia-Hsing Huang, Taipei (TW)

(73) Assignee: Andrew Yu-Tse Liu, Taichung (TW)

( * ) Notice: Subject to any disclaimer, the term of this patent is extended or adjusted under 35 U.S.C. 154(b) by 834 days.

(21) Appl. No.: 12/127,045

(22) Filed: May 27, 2008

(65) Prior Publication Data

US 2009/0294615 A1 Dec. 3, 2009

(51) Int. Cl.
*B65D 83/00* (2006.01)
*F16B 1/00* (2006.01)

(52) U.S. Cl. ..... 222/402.15; 222/153.09; 222/323; 222/474; 239/375; 248/229.22; 248/312

(58) Field of Classification Search ..... 222/153.09, 222/153.1, 153.11, 174, 323, 324, 402.13, 222/402.15, 465.1, 470, 472–474; 239/375, 239/525, 526, 532; 248/229.22, 229.25, 248/229.26, 312–313
See application file for complete search history.

(56) References Cited

U.S. PATENT DOCUMENTS 2,330,870 A * 10/1943 Collier ..... 43/56
2,960,260 A * 11/1960 Kutik ..... 222/473
4,505,335 A * 3/1985 Hayba ..... 169/76
4,660,745 A * 4/1987 Hess, Jr. ..... 222/174
5,819,985 A 10/1998 Brody ..... 222/153.09
6,981,622 B2 * 1/2006 Brody ..... 222/402.15

OTHER PUBLICATIONS

Chinese Utility Model No. CN 201023845 Y, Feb. 20, 2008, 15 pages.
Japanese Patent Publication No. JP 9124082 A, May 13, 1997, 4 pages.

* cited by examiner

*Primary Examiner* — J Casimer Jacyna
(74) *Attorney, Agent, or Firm* — Alan Kamrath; Kamrath & Associates PA

(57) ABSTRACT

A holder apparatus includes a handhold formed on an end thereof for holding and a barrel section extending from another end thereof. A clamping section is formed from the front end of the barrel section opposite to the handhold and includes two jaw portions joined together, two limited grooves respectively formed in and extending along the two jaw portions, two inner rim portions respectively defined against the two limited grooves and two clamping edges respectively formed on the inner wall of the two jaw portions related to the two limited grooves. The clamping edges grip a neck of a sprayer and support the bottom of a rim of a sprayer. A trigger element is pivotally connected to the barrel section. A C-shaped spring is disposed in the two limited grooves and grips the inner rim portions related to the two clamping edges.

15 Claims, 11 Drawing Sheets

HOLDER APPARATUS ADAPTED FOR GRIPPING AND OPERATING A SPRAYER

BACKGROUND OF THE INVENTION

1. Field of the Invention

The present invention relates to a holder apparatus adapted for gripping and operating a sprayer.

2. Description of the Related Art

Disclosed in U.S. Pat. No. 5,819,985 is a device 10 for actuating and holding a sprayer 12. The sprayer 12 includes a push-button valve 14 and a rim 26. The actuating and holding device 10 includes a body 16 and a locking ring 38.

The body 16 includes a handle 18 and a forward portion 20. The forward portion 20 includes an engagement element 22 for engagement with the rim 26 of the sprayer 12. The engagement element 22 includes a gap 24 defined therein, cam surfaces 52 formed on an external edge and a slot 46 defined in the external edge. A trigger 36 is provided on the handle 18. A lever 30 includes an end located in the gap 24 and an opposite end connected to the trigger 36.

The locking ring 38 includes a straight portion 40, two prongs 44 extended from an internal edge and an engagement finger 48 extended from the internal edge. The engagement finger 48 is located corresponding to the straight portion 40.

The locking ring 38 is installed around the engagement element 22. The internal edge of the locking ring 38 is in compliance with the external edge of the engagement element 22 including the cam surfaces 52. The prongs 44 are inserted in the slot 46. Thus, the locking ring 38 is not rotational relative to the engagement element 22. When the trigger 36 is operated, the push-button valve 14 is pushed via the lever 30.

There are problems encountered in the use of this conventional actuating and holding device 10. Firstly, it is not durable. The engagement element 22 is made of plastic. The cam surfaces 52 are worn away after some time of use so that the contact between the external edge of the engagement element 22 and the internal edge of the locking ring 38 is loose.

Secondly, it is inconvenient. The engagement finger 48 must be pushed downwards so that the prongs 44 can be inserted into the slot 46. The engagement finger 48 must be pushed upwards so that the prongs 44 are removed from the slot 46. Space around the engagement finger 48 is, however, limited and renders it difficult to operate the engagement finger 48. Moreover, the locking ring 38 is arranged around the engagement element 22 after the engagement element 22 is arranged around the rim 26. The area of the locking ring 38 and that of the engagement element 22 are, however, limited and render it difficult to operate the locking ring 38 and the engagement element 22.

Therefore, the present invention is intended to obviate or at least alleviate the problems encountered in the prior art.

SUMMARY OF THE INVENTION

It is therefore an object of the present invention to provide a holder apparatus adapted for gripping and operating a sprayer. Accordingly, the present invention provides a holder apparatus including a trigger element and a grip element. The holder apparatus further has a handhold defined on an end thereof, a barrel section extending from another end thereof and a clamping section formed on the front end of the barrel section opposite to the trigger element. The clamping section includes two jaw portions, a compartment defined between the jaw portions and adapted for receiving an end of the sprayer, an arcature limited groove and an inner rim portion formed in each of the jaw portions and a clamping edge formed on the inner wall of each of the inner rim portions. The clamping edges grip on a neck of the sprayer and support the bottom of a rim of the sprayer. The trigger element pivotally connects to the barrel section and is adapted for operating a push-button valve of the sprayer to spray the contents of the sprayer. The grip element is in a form of a rectangular plate bar and bent to be C-shaped. The grip element is provided in the limited grooves and grips on the inner rim portions.

Other objectives, advantages, and features of the invention will become more apparent from the following detailed description when taken in conjunction with the accompanying drawings.

BRIEF DESCRIPTION OF THE DRAWINGS

The present invention will be described via detailed illustration of the preferred embodiment embodiments referring to the drawings.

DETAILED DESCRIPTION OF THE PREFERRED EMBODIMENT

Figure 1:
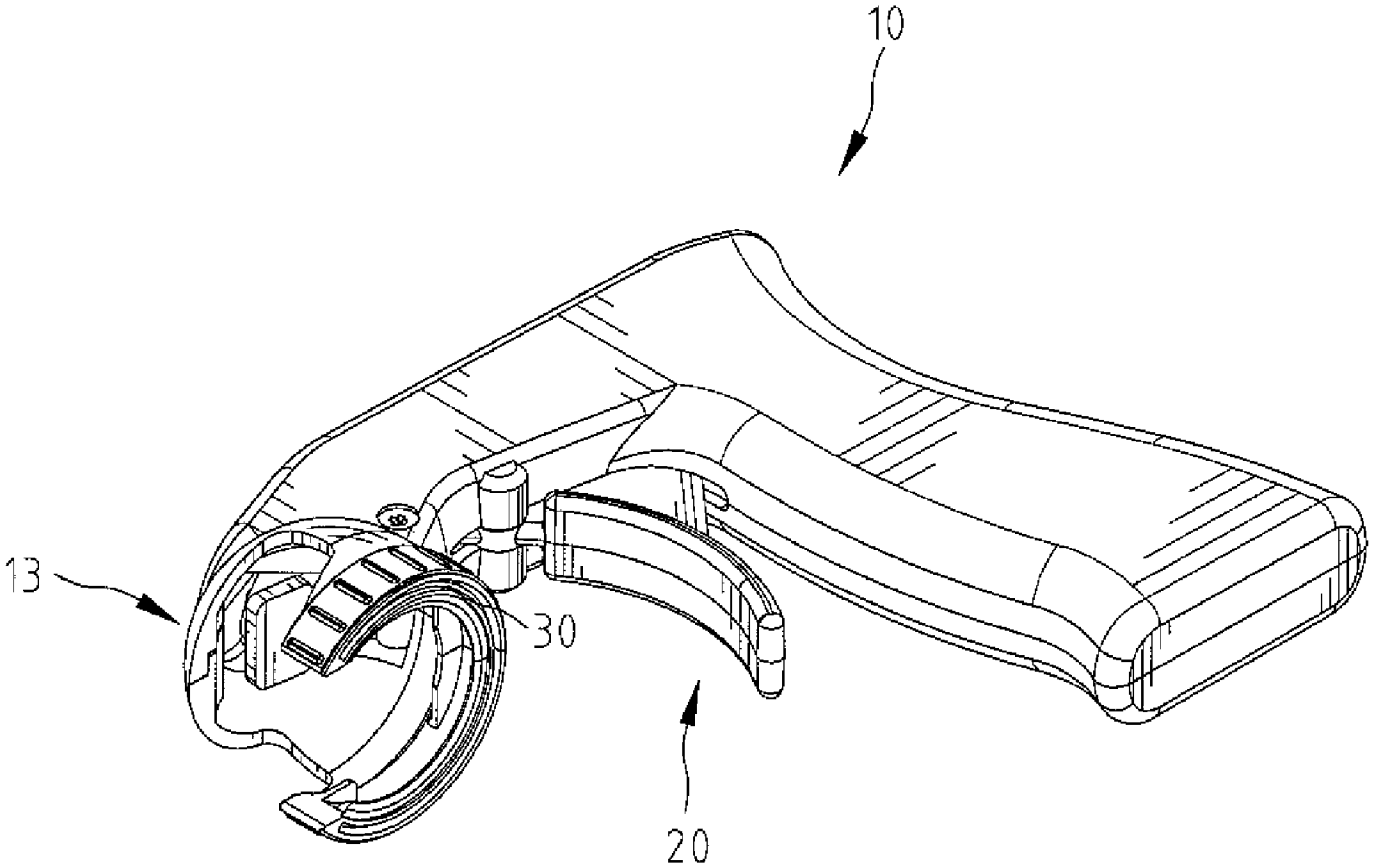
FIG. 1 is a perspective view of a holder apparatus according to the first embodiment of the present invention.
Figure 2:
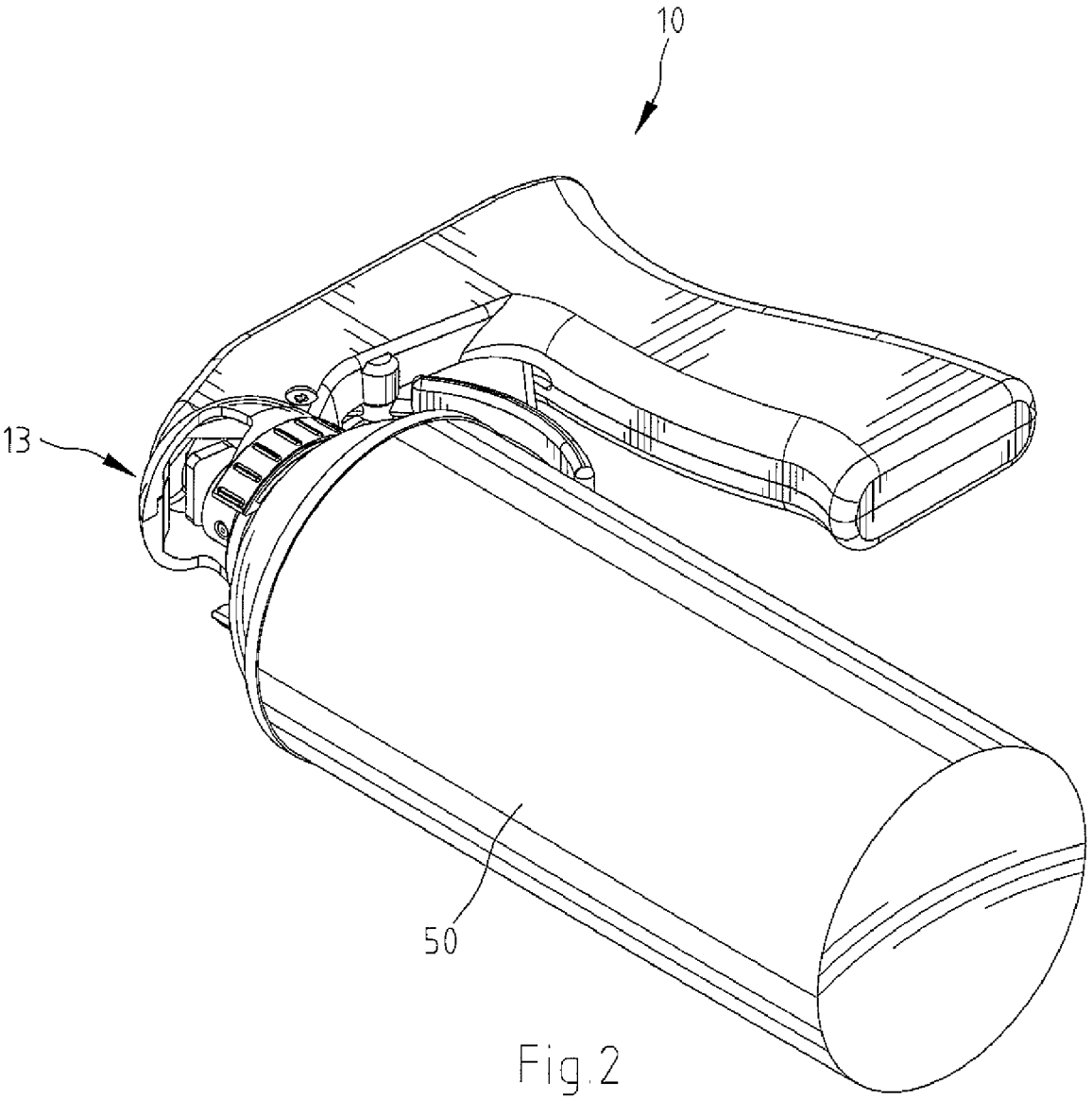
FIG. 2 is a perspective view of the holder apparatus shown in FIG. 1, with the holder apparatus clamping a sprayer.
Figure 3:
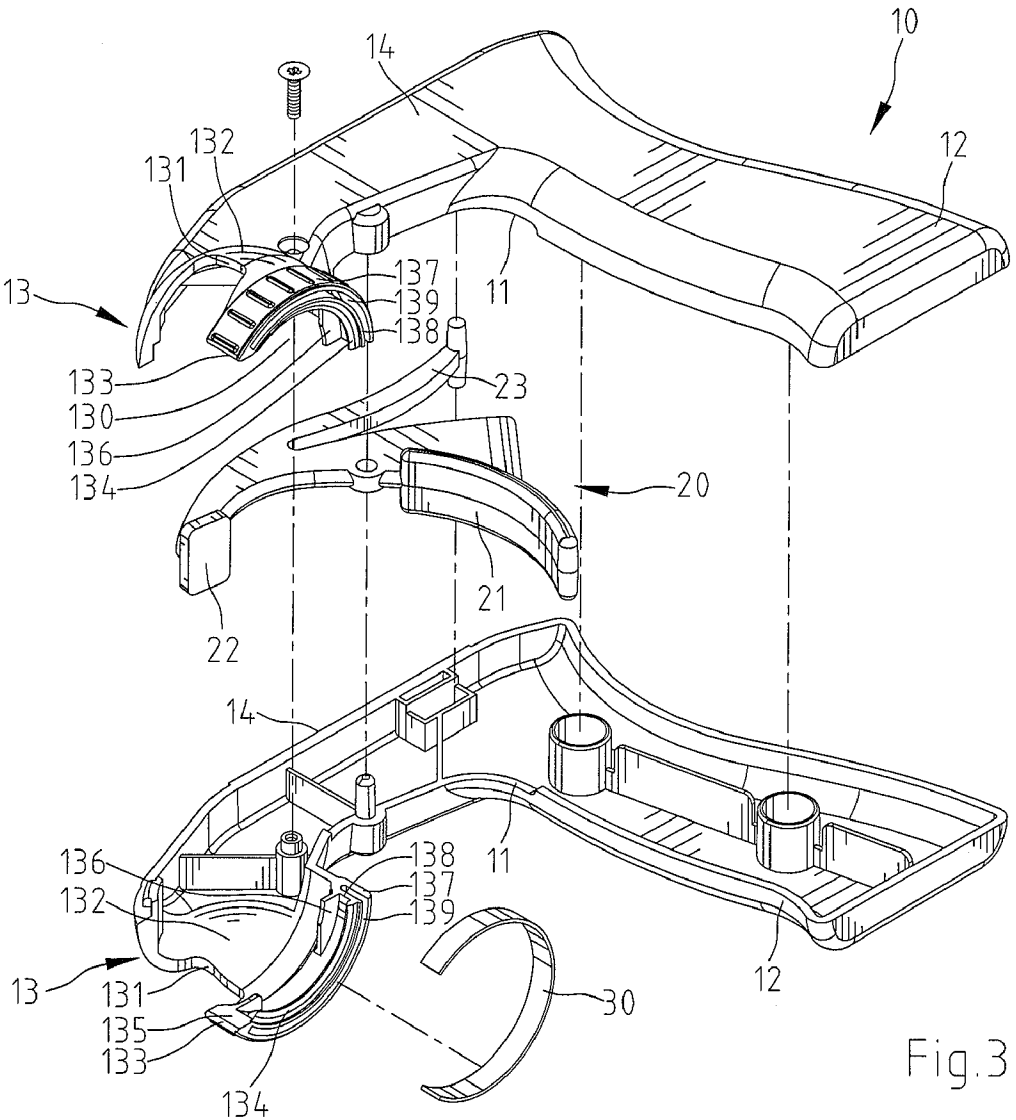
FIG. 3 is an exploded view of the sprayer clamped by the holder apparatus shown in FIG. 1.

Referring to FIGS. 1 and 2, a holder apparatus 10 adapted for gripping and operating a sprayer 50 in accordance with a first embodiment of the present invention includes a trigger element 20 and a grip element 30. The holder apparatus 10 further forms a clamping section 13 for gripping the sprayer 50 easily.

Referring to FIGS. 3 through 6, the holder apparatus 10 that has bilateral symmetry consists of two halves 11, with the halves 11 corresponding to and joined with each other. Each of the halves 11 is formed integrally as one piece. A handhold 12 is extendedly formed from an end of the holder apparatus 10 for a user to hold. A barrel section 14 is extendedly formed from another end of the holder apparatus 10, with the clamping section 13 provided on the front end of the barrel section 14. The direction of the axis of the handhold 12 is approximately perpendicular to that of the barrel section 14.

The clamping section 13 that also has bilateral symmetry includes two jaw portions 132 joined together, with two outer rim portions 137 and two inner limited rim portions 138 respectively formed from the bottom of the jaw portions 132. Particularly referring to FIG. 6, each of the outer rim portions 137 and the related one of the limited rim portions 138 define a limited groove 139 therebetween. Each limited groove 139 is in a form of an arc. Each of the limited rim portions 138 further forms a clamping edge 134 and a limited portion 136 on the inner side thereof corresponding to the related limited groove 139, with the clamping edge 134 and the limited portion 136 spaced from each other. A gap 133 is formed on the front end of each of the jaw portions 132. An abutted portion 135 is provided between each of the gaps 133 and the related one of the clamping edges 134. While the jaw portions 132 are joined to each other, the clamping section 13 defines a compartment 130 and a vent 131, with the compartment 130 formed between the jaw portions 132 of the clamping section 13 for receiving the sprayer 50, with the vent 131 being in communication with the compartment 130.

The trigger element 20 is pivotally connected to the barrel section 14 and includes a trigger portion 21 formed on a side of the rear end thereof, a pressed portion 22 formed on the front end thereof and a spring portion 23 extending from another side of the rear end thereof opposite to the trigger portion 21. The trigger portion 21 is located in front of the handhold 12 for the user to operate. The pressed portion 22 is adjacent to the vent 131 and above the top of the sprayer 50. The spring portion 23 is abutted against the inner wall of the barrel section 14 and provides the trigger element 20 with a return resilience.

The grip element 30 is in a form of a rectangular plate bar and bent to be C-shaped. The grip element 30 is provided in the limited grooves 139 and grips on the inner rim portions 138. The clamping edges 134 and limited portions 136 can be also supported by the grip element 30. The outer rim portions 137 are provided to delimit the grip element 30 for preventing the grip element 30 from being excessively deformed.

Figure 4:
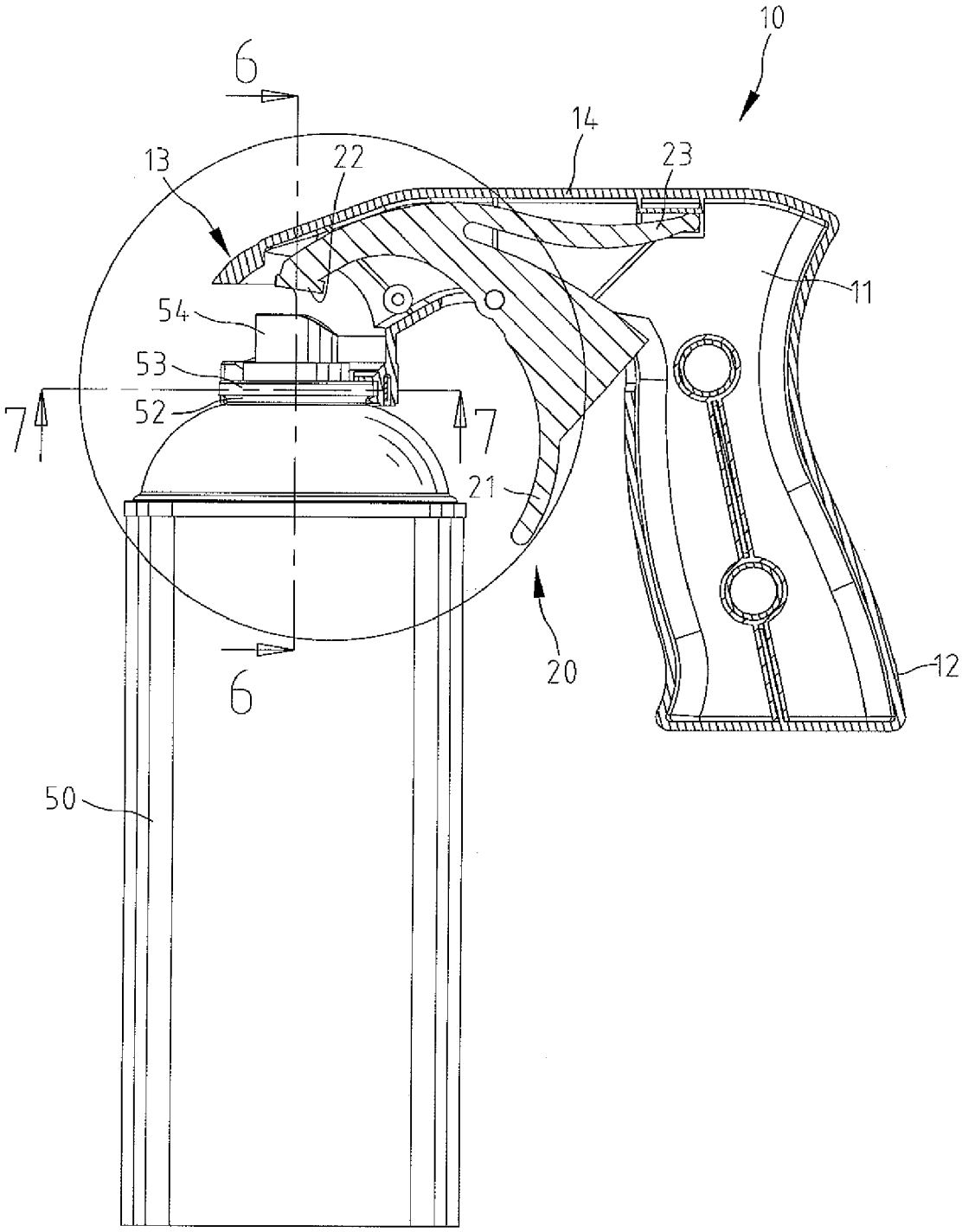
FIG. 4 is a cross-sectional view of the holder apparatus and the sprayer shown in FIG. 2.
Figure 5:
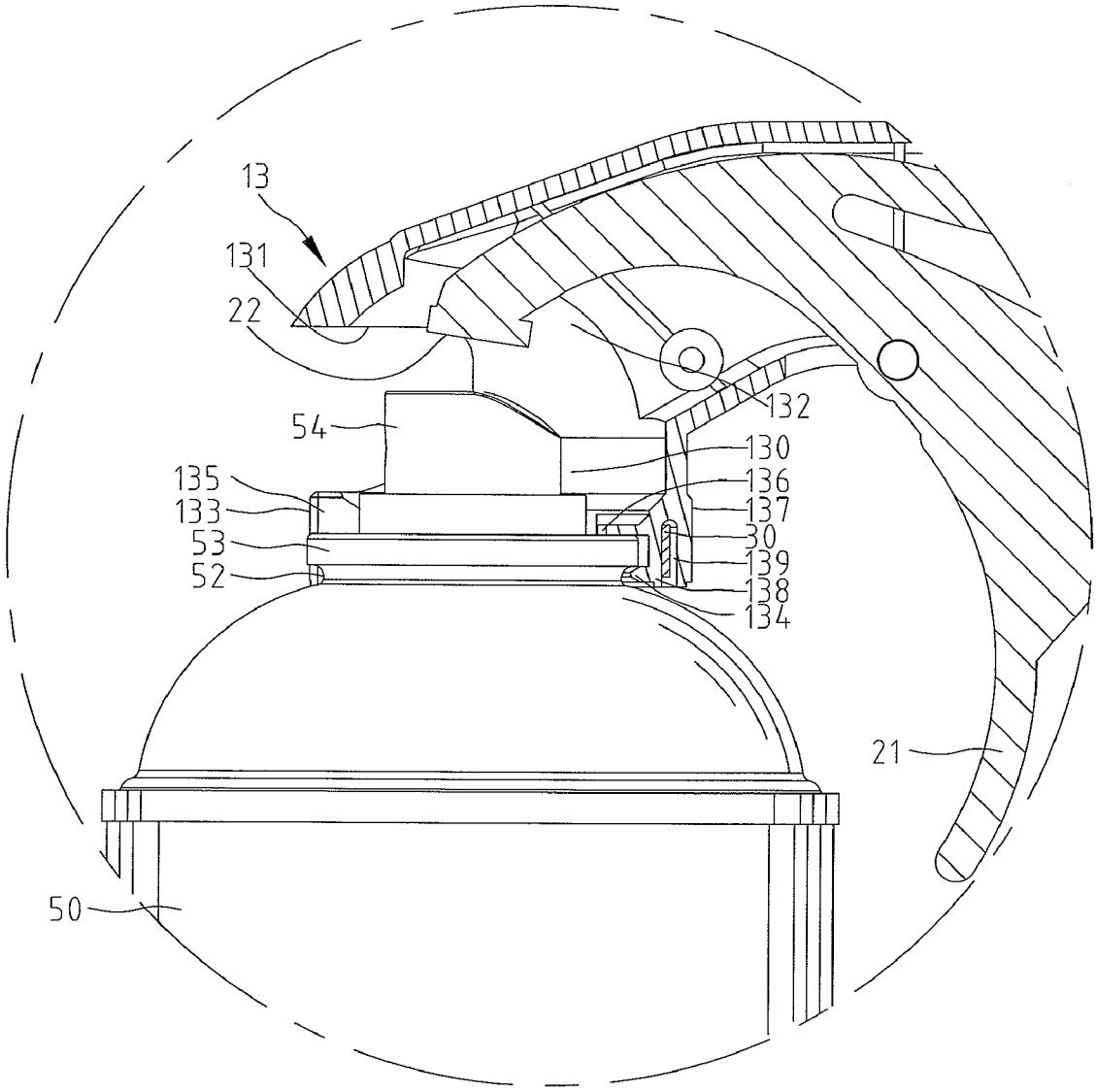
FIG. 5 is aerially an enlarged view of the holder apparatus and the sprayer shown encircled in FIG. 4.
Figure 6:
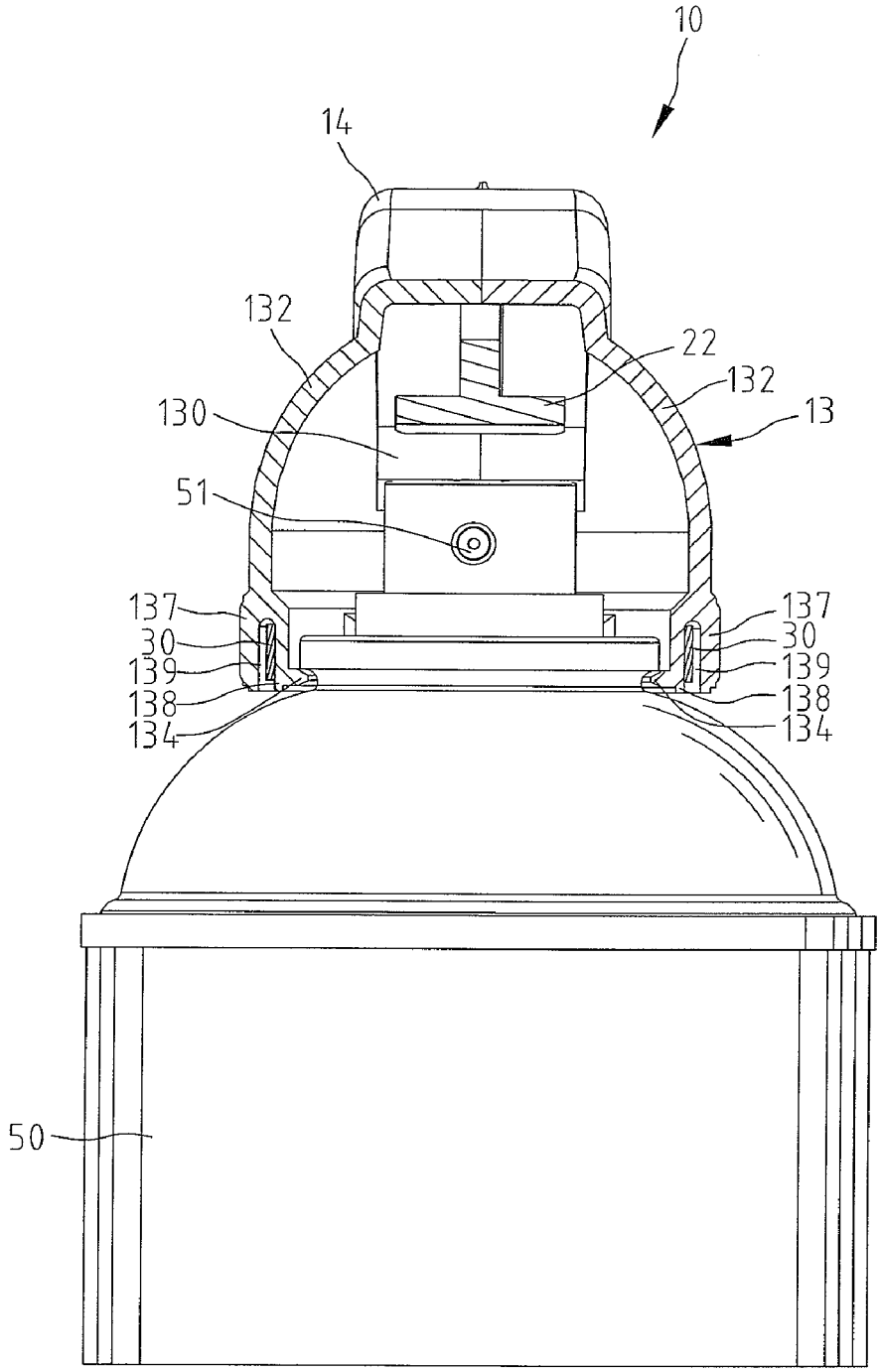
FIG. 6 is a cross-sectional view taken along line 6-6 in FIG. 4.
Figure 7:
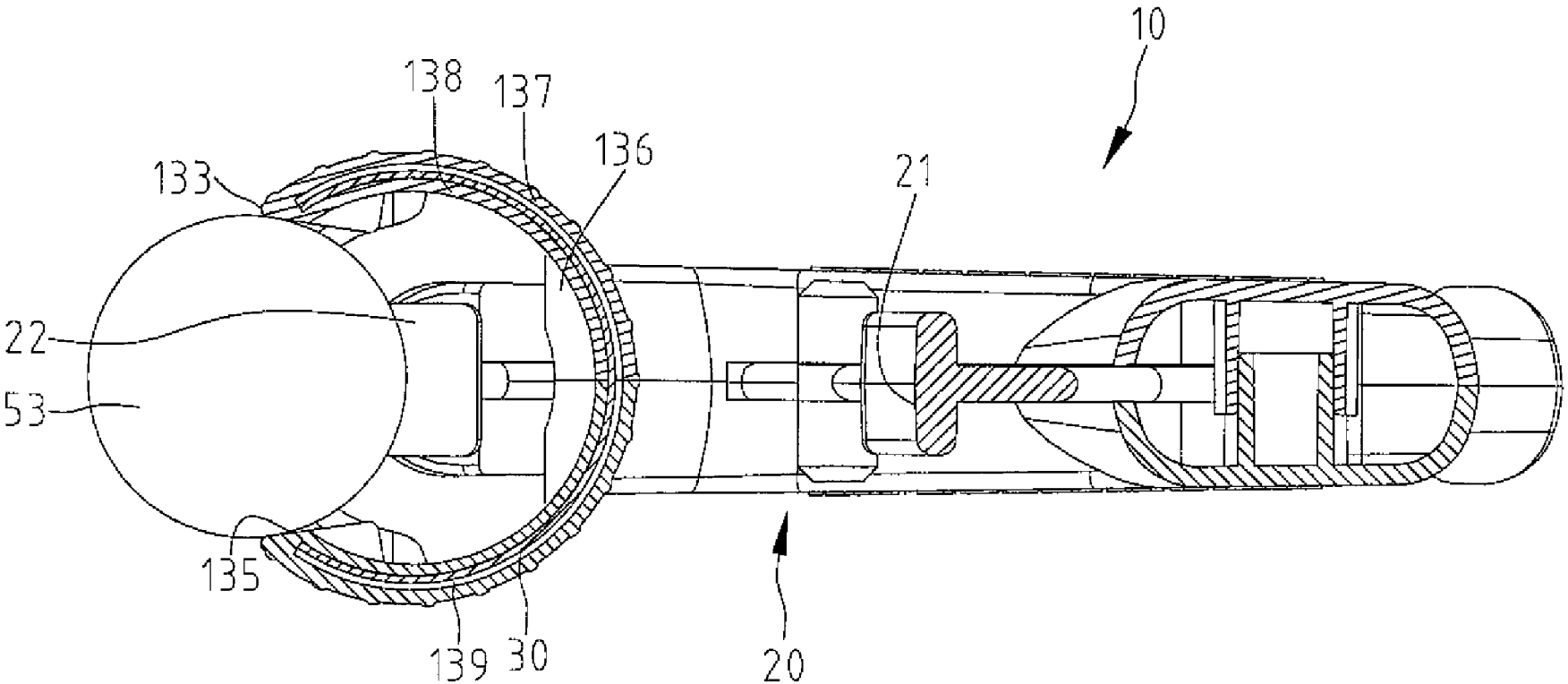
FIG. 7 is a cross-sectional view taken along line 7-7 in FIG. 4.
Figure 8:
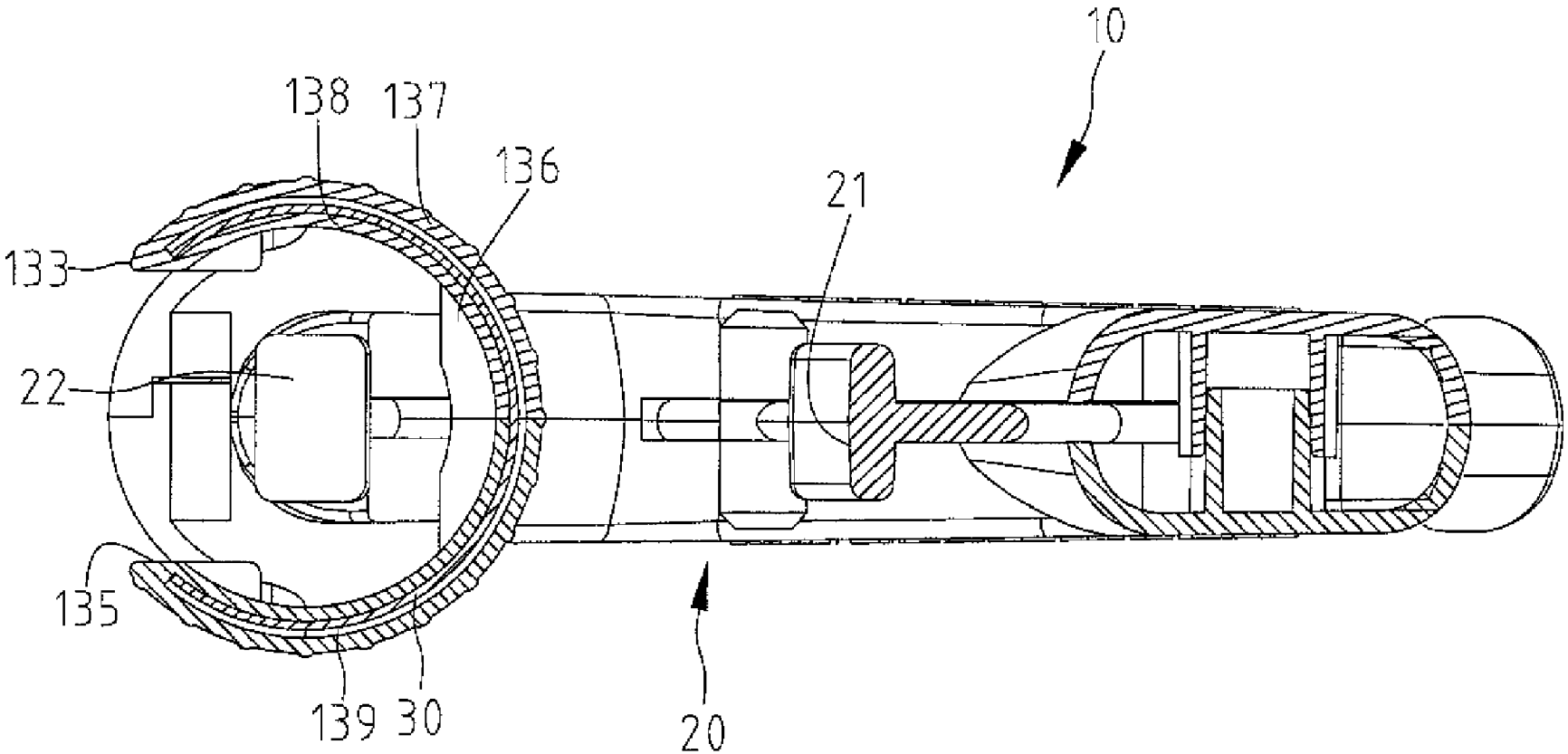
FIG. 8 is another cross-sectional view similar to FIG. 7, illustrating the holder apparatus not yet clamping the sprayer.

The sprayer 50 includes a nozzle 51, a neck 52, a rim 53 and a push-button valve 54 (shown in FIG. 4). However, the sprayer 50 is conventional so that the detailed structure of the sprayer 50 would not be described. Referring to FIGS. 7 and 8 simultaneously, while the sprayer 50 is going to be clamped by the clamping section 13, a side of the neck 52 of the sprayer 50 is pointed towards the gaps 133, and the sprayer 50 is pushed towards the compartment 130 so that the neck 52 of the sprayer 50 is in contact with the abutted portions 135. In the meanwhile, the jaw portions 132 are deformed as to push the clamping edges 134 respectively outwardly. Thus, the end of the sprayer 50 above the neck 52 is put in the compartment 130, and, then, the jaw portions 132 grip on the neck 52 of the sprayer 50 via the return resilience of the grip element 30.

While the sprayer 50 is gripped by the clamping section 13, the nozzle 51 faces the vent 131 of the clamping section 13, the clamping edges 134 grip on the neck 52 and support the bottom of the rim 53, the neck 52 further abuts against the abutted portions 135, and the limited portions 136 are disposed above the rim 53 for fixing the sprayer 50 to the clamping section 13. At the same time, the pressed portion 22 is provided adjacent to the push-button valve 54. When the user wants to operate the trigger element 20 to spray the contents in the sprayer 50, he or she has to pull the trigger portion 21 towards the handhold 12 as to drive the pressed portion 22 to move downwardly and press the push-button valve 54. Then, the spring portion 23 is driven to tighten. While the user stops operating the trigger portion 21, the spring portion 23 is going to release and returns the pressed portion 22 to the original position.

Figure 9:
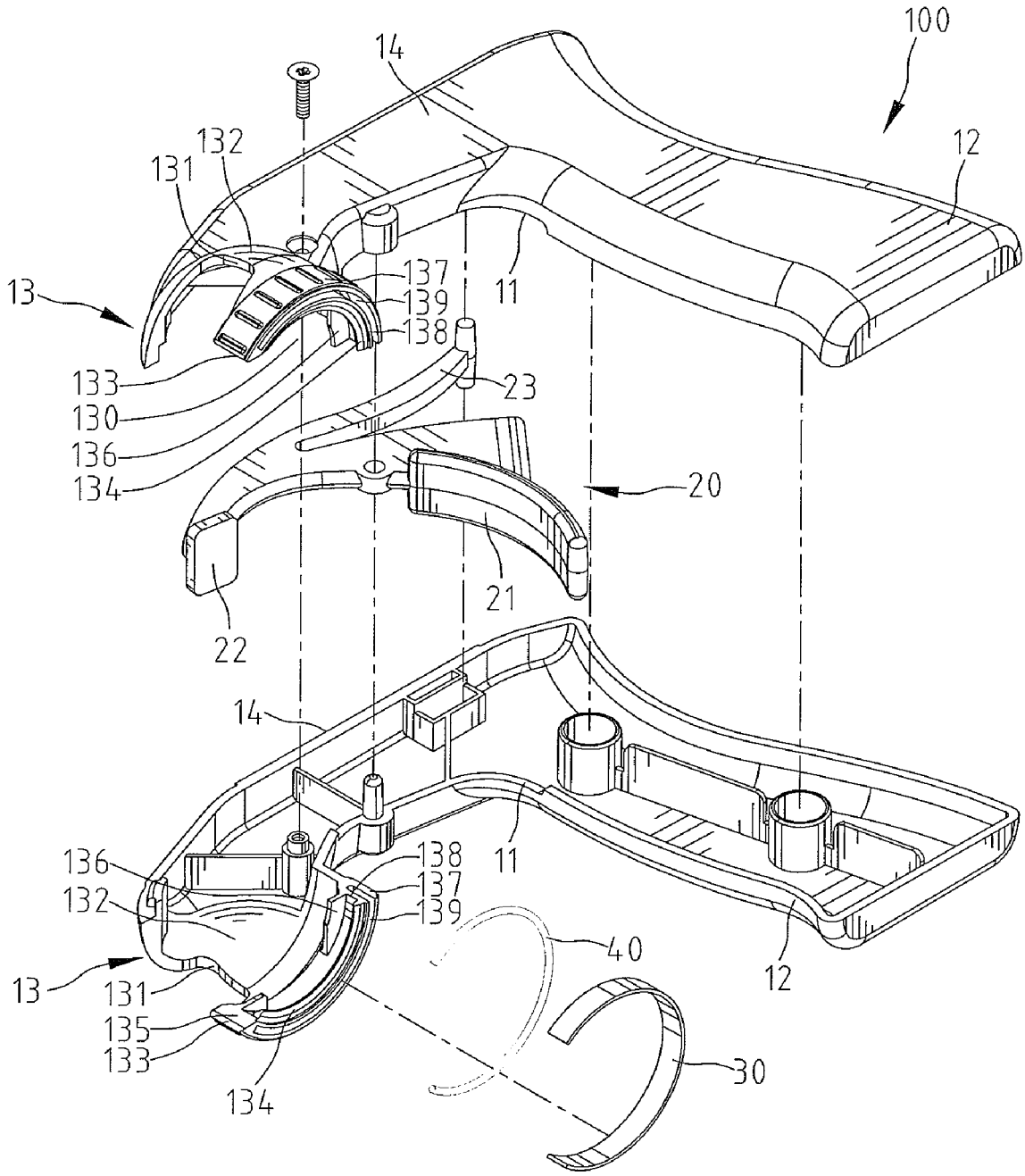
FIG. 9 is an exploded view of a holder apparatus according to the second embodiment of the present invention.
Figure 10:
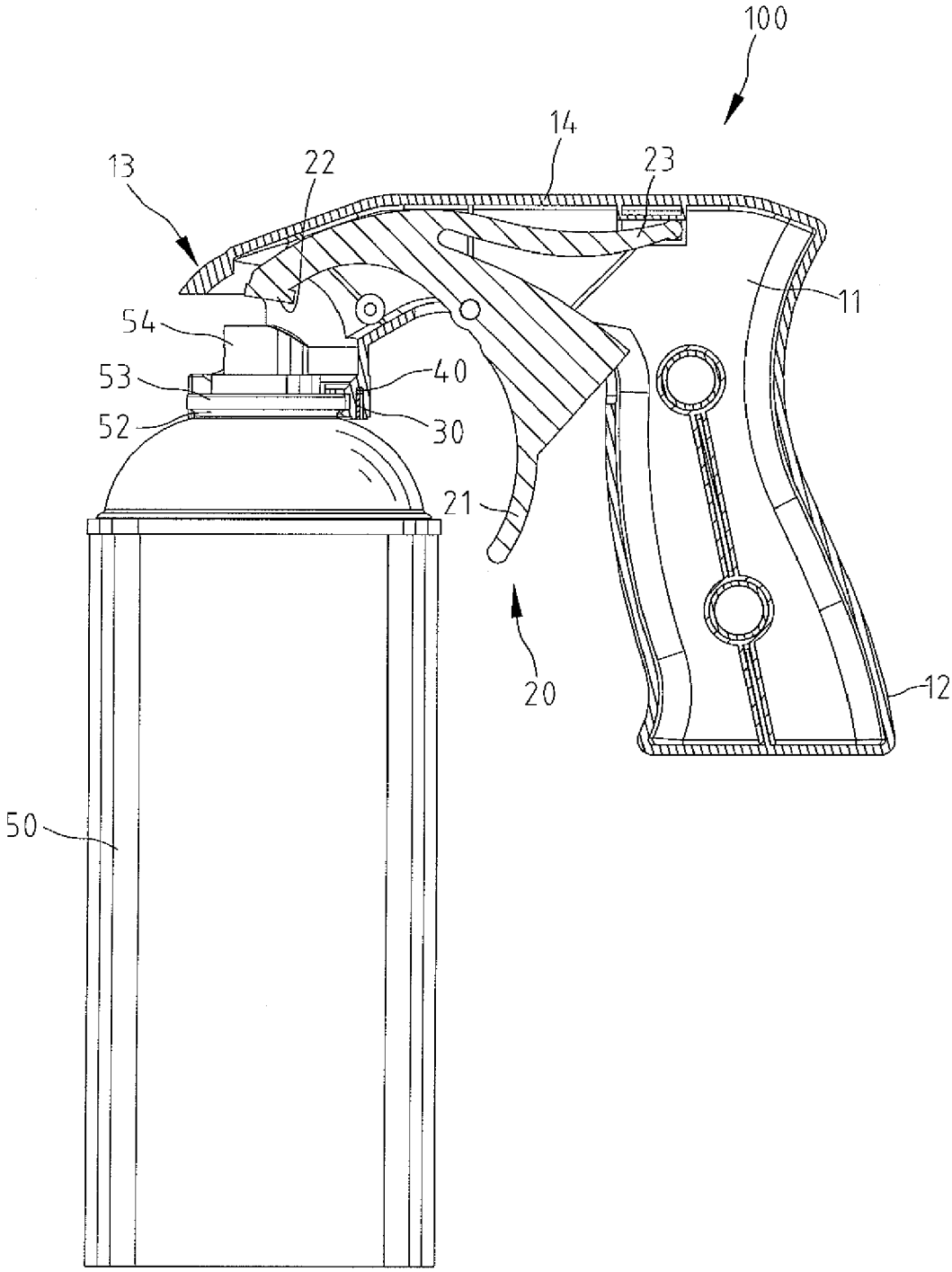
FIG. 10 is a cross-sectional view of the holder apparatus and the sprayer shown in FIG. 9.
Figure 11:
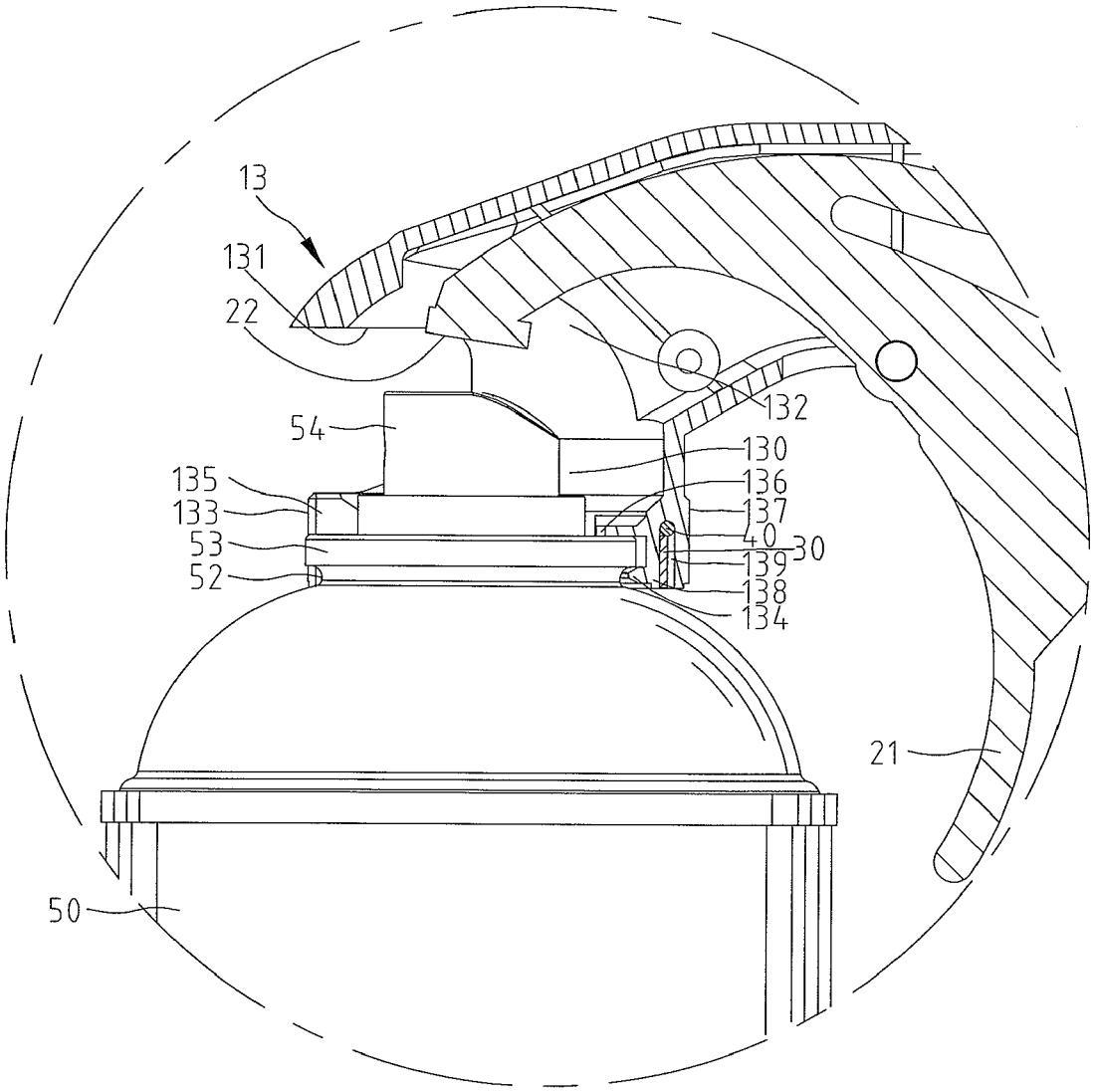
FIG. 11 is a partially enlarged view of the holder apparatus and the sprayer shown in FIG. 10.

Referring to FIGS. 9 through 11, a holder apparatus 100 in accordance with a second embodiment of the present invention is similar to the holder apparatus 10 except further including an elastic element The elastic element 40 is disposed in the limited groove 139, and then, the grip element 30 is set into the limited groove 139 and abuts against the elastic element 40 as to prevent the elastic element 40 disengaging from the limited groove 139 and as to enhance the force for the jaw portions 132 gripping on the neck 52 of the sprayer 50. In this embodiment, the elastic element 40 is in a form of a C-shaped spring.

What is claimed is:

1. A holder apparatus for gripping and operating a sprayer that includes a neck and a rim and comprising:

a handhold for holding by a user;

a barrel section extending from the handhold;

a clamping section formed from a front end of the barrel section opposite to the handhold and including two jaw portions joined together, two limited grooves respectively formed in and extending along the two jaw portions, two inner rim portions respectively defined against the limited grooves and two clamping edges respectively formed on the inner wall of the two jaw portions related to the two limited grooves, with the two clamping edges gripping the neck of the sprayer and supporting the bottom of the rim of the sprayer;

a trigger element pivotally connected to the barrel section;

a grip element in a form of a rectangular plate bar and bent to be C-shaped provided in the two limited grooves and gripping the inner rim portions related to the clamping edges; and an outer rim portion defined on each of the two jaw portions for limiting the grip element, with each of the two limited grooves defined between each of the two inner rim portions and the related outer rim portion.

2. The holder apparatus as claimed in claim 1, further comprising a limited portion formed on the inner wall of each of the two jaw portions opposite to the related limited groove, with each of the two limited portions spaced from the related clamping edge, with the two limited portions disposed above the rim of the sprayer for fixing the sprayer to the clamping section.

3. The holder apparatus as claimed in claim 1, further comprising a gap formed on the front end of each of the two jaw portions, with a compartment formed between the two jaw portions for receiving the sprayer, with an end of the sprayer entering the compartment of the clamping section from the gaps and an abutted portion provided between each of the gaps and the related clamping edge for abutting against the neck of the sprayer.

4. The holder apparatus as claimed in claim 2, further comprising a gap formed on the front end of each of the two jaw portions, with a compartment formed between the two jaw portions for receiving the sprayer, with an end of the sprayer entering the compartment of the clamping section from the gaps and an abutted portion provided between each of the gaps and the related clamping edge for abutting against the neck of the sprayer.

5. The holder apparatus as claimed in claim 3, wherein the trigger element further comprises a trigger portion formed on a side of a rear end thereof and a pressed portion formed on a front end thereof, with the trigger portion located in front of the handhold for the user to operate, with the pressed portion adapted for operating the sprayer to spray.

6. The holder apparatus as claimed in claim 4, wherein the trigger element further comprises a trigger portion formed on a side of a rear end thereof and a pressed portion formed on a front end thereof, with the trigger portion located in front of the handhold for the user to operate, with the pressed portion adapted for operating the sprayer to spray.

7. The holder apparatus as claimed in claim 5, wherein the trigger element further comprises a spring portion extending from another side of the rear end thereof opposite to the trigger portion, with the spring portion abutted against an inner wall of the barrel section and providing the trigger element with a return resilience.

8. The holder apparatus as claimed in claim 6, wherein the trigger element further comprises a spring portion extending from another side of the rear end thereof opposite to the trigger portion, with the spring portion abutted against an inner wall of the barrel section and providing the trigger element with a return resilience.

9. A holder apparatus for gripping and operating a sprayer that includes a neck and a rim and comprising:

a handhold for holding by a user;

a barrel section extending from the handhold;

a clamping section formed from a front end of the barrel section opposite to the handhold and including two jaw portions joined together, two limited grooves respectively formed in and extending along the two jaw portions, two inner rim portions respectively defined against the limited grooves and two clamping edges respectively formed on the inner wall of the two jaw portions related to the two limited grooves, with the two clamping edges gripping the neck of the sprayer and supporting the bottom of the rim of the sprayer;

a trigger element pivotally connected to the barrel section;

an elastic element in a form of a C-shaped spring provided in the two limited grooves and gripping the inner rim portions related to the two clamping edges;

a grip element in a form of a rectangular plate bar and bent to be C-shaped provided in the two limited grooves and abutting against the elastic element for preventing the elastic element from disengaging from the two limited grooves; and an outer rim portion defined on each of the two jaw portions for limiting the elastic element and the grip element, with each of the two limited grooves defined between each of the two inner rim portions and the related outer rim portion.

10. The holder apparatus as claimed in claim 9, further comprising a limited portion formed on the inner wall of each of the two jaw portions opposite to the related limited groove, with each of the two limited portions spaced from the related clamping edge, with the two limited portions disposed above the rim of the sprayer for fixing the sprayer to the clamping section.

11. The holder apparatus as claimed in claim 9, further comprising a gap formed on the front end of each of the two jaw portions, with a compartment formed between the two jaw portions for receiving the sprayer, with an end of the sprayer entering the compartment of the clamping section from the gaps and an abutted portion provided between each of the gaps and the related clamping edge for abutting against the neck of the sprayer.

12. The holder apparatus as claimed in claim 10, further comprising a gap formed on the front end of each of the two jaw portions, with a compartment formed between the two jaw portions for receiving the sprayer, with an end of the sprayer entering the compartment of the clamping section from the gaps and an abutted portion provided between each of the gaps and the related clamping edge for abutting against the neck of the sprayer.

13. The holder apparatus as claimed in claim 11, wherein the trigger element further comprises a trigger portion formed on a side of a rear end thereof and a pressed portion formed on a front end thereof, with the trigger portion located in front of the handhold for the user to operate, with the pressed portion adapted for operating the sprayer to spray.

14. The holder apparatus as claimed in claim 12, wherein the trigger element further comprises a trigger portion formed on a side of a rear end thereof and a pressed portion formed on a front end thereof, with the trigger portion located in front of the handhold for the user to operate, with the pressed portion adapted for operating the sprayer to spray.

15. The holder apparatus as claimed in claim 13, wherein the trigger element further comprises a spring portion extending from another side of the rear end thereof opposite to the trigger portion, with the spring portion abutted against an inner wall of the barrel section and providing the trigger element with a return resilience.

* * * * *